United States Patent [19]

Ferguson et al.

[11] Patent Number: 4,673,920

[45] Date of Patent: Jun. 16, 1987

[54] FIRE ALARM CONTROL AND EMERGENCY COMMUNICATION SYSTEM

[75] Inventors: Harry D. Ferguson; Kar-Kui Lee; William Oliver; Fat-Cho Kwong; Ronald Young; Jim Hammell; Keith Morrow, all of Owen Sound, Canada; Rashid A. Chaudhary, Hanson, Mass.

[73] Assignee: General Signal Corporation, Stamford, Conn.

[21] Appl. No.: 609,173

[22] Filed: May 11, 1984

[51] Int. Cl.[4] ..... G08B 19/00

[52] U.S. Cl. ..... 340/521; 340/506; 340/508; 340/531; 340/505

[58] Field of Search ..... 340/521, 506, 508, 531, 340/532, 825.06, 825.54, 825.55, 505

[56] References Cited

U.S. PATENT DOCUMENTS 3,909,826 9/1975 Schildmeier et al. ..... 340/539
4,041,470 8/1977 Slane et al. ..... 340/505
4,392,125 7/1983 Iwata ..... 340/505
4,400,694 8/1983 Wong et al. ..... 340/505

*Primary Examiner*—Donnie L. Crosland
*Attorney, Agent, or Firm*—Robert R. Hubbard; Milton E. Kleinman

[57] ABSTRACT

A multistationed integrated life safety system in which each station will be situated at a diffferent location and have complete capabilities in terms of local fire protection, fire detection, control and/or monitoring and controlling the security of an area. Each station communicates with four adjacent stations so that when an event occurs at one station, that station is programmed to cause that information or that new status to be transmitted to each of the four adjacent stations. Thus, each station will be interconnected or networked to four other stations to provide multiple location control and annunciation so that each station may act independently.

3 Claims, 4 Drawing Figures

FIRE ALARM CONTROL AND EMERGENCY COMMUNICATION SYSTEM

BACKGROUND OF THE INVENTION

1. Field of the Invention

This invention relates to electronic circuits, and more particularly to fire alarm control and emergency communication systems.

2. Description of the Prior Art

The discovery of fire by mankind marked the dawn of civilization. From that time to the present, man has benefited by the use of fire. Each year many fires will start accidentally or become out of control causing a great deal of human suffering and possible human death and/or a large amount of property damage. Fire alarm control systems have been developed to protect people and property. Typical prior art fire alarm control systems consisted of a master controller which usually had indicator lights, control switches and power for the entire system.

The master controller was connected to the systems inputs, i.e., smoke detectors and manual pull stations. The master controller made all the decisions regarding how the system was going to respond to various patterns of inputs and the master controller activated or controlled all system outputs. The master controller was wired directly to each of the aforementioned input devices, or wired to a slave device, i.e., a data gathering panel which was wired to the input devices. If there was no danger present, the master controller would communicate with the input that was located at the first address, and the input device located at the first address would communicate its status to the master controller. Then, the master controller would communicate with the input that was located at the second address and the input device located at the second address would communicate its status to the master controller. This sequential process would continue until all the addresses were serially polled. When the master controller received an answer from the input device located at the last address, the master controller would go back to the first address and ask the input device located at the first address for its status. The foregoing process would continue adinfinitum.

In the event one of the input devices detected a possible dangerous condition, i.e., smoke in the third floor, the master controller would have to decide whether or not to process that input immediately or whether to wait until it communicated with the entire system and determined the status of all the inputs. If the master controller elected to process the input response immediately, it might tell the people located on the third floor to evacuate the building, cause fresh air to be circulated on the third floor, and warn the people located on the second and fouth floors of a pending emergency. By processing the first received dangerous condition signal immediately, the master controller would not known that the fire was located on the fifth floor. The master controller may ring an evacuation signal on a floor that does not have to be evacuated at that moment, increasing the danger and possible panic that may result when a floor that should have been evacuated was not evacuated. The reason for the above is that in many fires smoke may leak up a stairwell or be moved by the air handling system. Typically more people die from smoke inhalation than burns caused by fire, so improper air handling may be diastrous. Thus, the master controller risked implementing the wrong response or an incomplete partial response. If instead of reacting immediately to the input devices report of a possible dangerous condition, the master controller polled all the remaining inputs to the system to be sure that it had a new complete picture of the conditions of the building so that its response would more likely be correct, the master controller would take significantly longer before it acts. The basic fact about any fire condition remains: the faster an emergency condition can be detected and measures taken to control the fire, the more efficiently the danger can be controlled. Thus, one of the problems of the prior art was that if the master controller processed an input indicating an abnormal condition immediately it risked the incorrect response or activating its responses in the improper time sequence. Furthermore, if the master controller continued receiving new inputs its response was slower. The foregoing prior art problems became more severe as the buildings in which we live, work, and are entertained in become larger, taller, multi-towered or more spread out like a large shopping mall, university campus or hospital complex.

Another problem of the prior art was that the total status of the building or buildings could only be determined at one location, i.e., the location of the master controller. The master controller may not be located near the entrance that the firemen arrive, or if the master controller was consumed by fire or made inaccessible because of the fire, the entire fire alarm system would not operate.

Another problem of the prior art was that since the input devices were serially connected to the master controller, the failure of any point on the serial link would cause the failure of all remaining input devices connected to that link.

A further problem with the prior art was that there was a limit to the number of input devices that could be connected to a given master controller. Thus, it might be very expensive or impossible to expand a prior art fire alarm system to accommodate future needs.

An additional problem of the prior art was that it was necessary to decide whether a fire alarm systems inputs would be multiplexed or full wired. Installaton costs of prior art fire alarm systems typically equaled hardware costs. By reducing the number of wires in a system the cost of the wire and the cost of drawing the wire would be reduced. Hence, multiplexing techniques were used to reduce the total cost of the alarm system. In the same prior art system some inputs could not be multiplexed and other inputs hard wired.

SUMMARY OF THE INVENTION

This invention overcomes the problems of the prior art by providing a multi-node versatile integrated fire alarm and emergency communication system wherein each node will be located at a different location and will have complete capabilities in terms of local fire protection, fire detection and control. Each node communicates with four adjacent nodes. When an event or alarm condition occurs at one node, that node is programmed to cause that information or that new status to be transmitted to each of the four adjacent nodes. Thus, each node will be interconnected or networked to four other nodes to provide multiple location control and annunciation so that each node will have a so called stand alone capability allowing each node to act as a control center with no one node having priority over any other node.

Thus, the destruction or inaccessibility of any one node will not prevent the entire fire alarm and emergency communication system from functioning.

A node may be a conventional fire alarm system that includes smoke detectors, alarm bells, manual pull stations, annunciators, speakers, telephones, with the addition of three computers. The first computer is a microprocessor with a memory. The first computer acts as a central processing unit which controls the local fire alarm decision making and processing functions. The second computer is a microprocessor and memory unit that acts as a serial link controller which provides a channel to each of the adjacent four nodes, and a communications link to the first computer. The third computer is a microprocessor and memory unit that acts as a serial link controller which provides a communications link between the first computer, a printer and/or one or more data gathering panels or control panels. Three of the adjacent four nodes may be an intelligent terminal that is a self-contained microcomputer and CRT with a disc drive that provides an auxiliary display and control capabilities for the fire alarkm and emergency communication system.

The apparatus of this invention is faster than the fire alarm systems used in the prior art since the first computer does not have to interrogate every data collector, i.e., manual pull station and smoke detector in the system and each node is a stand alone fire alarm system that makes its own decisions. This system is also more flexible and readily expandable than the prior art systems since it is easier and perhaps cheaper to add additional nodes than to connect additional data detection devices which are either wired directly to a master controller or wired through slaves to a master controller. Furthermore, there is no limit to the number of nodes that may be interconnected. While there is a limit to the number of data detection devices that may be connected to a master controller.

It is an object of this invention to provide a new and improved fire alarm and emergency communication system.

It is a further object of this invention to provide a new and improved fire alarm and emergency communication system that has a multiplicity of nodes which are interconnected wherein each node makes its own decisions and is a stand alone fire alarm and emergency communication system.

Other objects and advantages of this invention will become apparent as the following description proceeds, which description should be considered together with the accompanying drawings.

DESCRIPTION OF A PREFERRED EMBODIMENT

Figure 1:
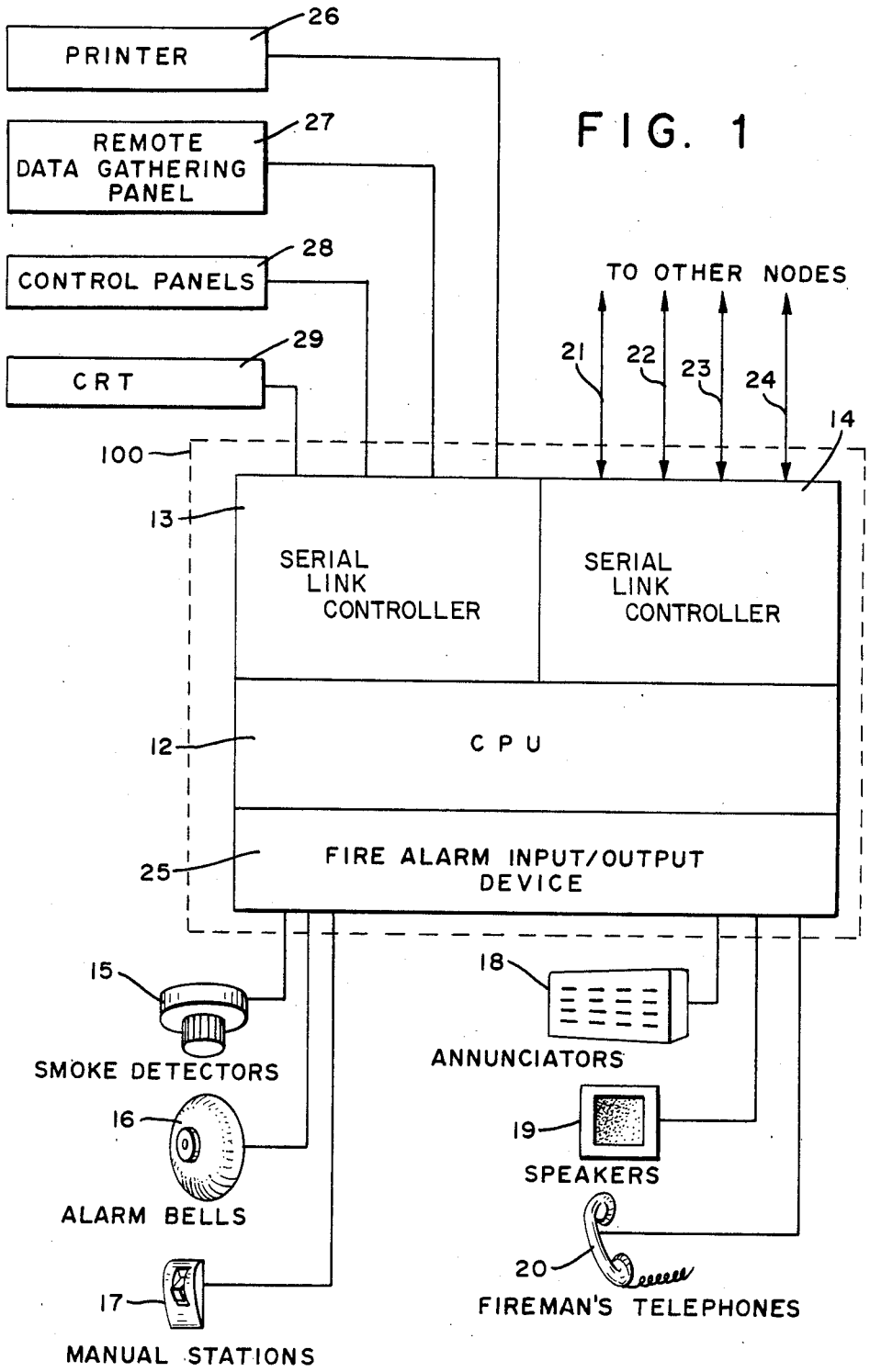
FIG. 1 is a block diagram of a node.

Referring now to the drawings in detail, and more particularly to FIG. 1, the reference character 100 represents a node. Node 100 comprises a central processing unit or computer (CPU) 12, a serial link controllers 13 which is coupled to CPU 12, a serial link controller 14 which is coupled to CPU 12. Fire alarm input/output device 25 that is coupled to CPU 12. Device 25 provides the interfacing or handshake requirements between CPU 12 and detectors 15, alarms 16, stations 17, annunciators 18, speakers 19, and telephones 20. A plurality of smoke detectors 15 that detect the presence of smoke caused by a fire are coupled to CPU 12. A plurality of alarm bells 16, manual stations 17, annunicators 18, speakers 19, and firemen's telephones 20 are coupled to CPU 12. When one or more detectors 15 indicate the presence of smoke or one or more manual stations 17 are activated, the program contained within CPU 12 will cause one or more alarm bells 16 to sound and information to be displayed on one or more annunciators 18 and/or a prerecorded message to be broadcast from one or more speakers 19. CPU 12 will activate circuits connected to remote fire department monitoring equipment to alert fire officials to the condition. After the fire department arrives, the fire captain may use one of the telephones 20 to communicate with specific areas of the building or buildings via speakers 19. In order to reduce labor and/or wiring costs any given node may have detectors 15, bells 16, stations 17, annunciators 18, speakers 19, and telephones 20 full wired or multiplexed. Serial link controllers 13 and 14 contain a microprocessor and a memory so that they may operate independently of CPU 12 to provide rapid system response. Serial link controller 14 is programmed so that when CPU 12 is notified of the occurrence of an event, i.e., smoke on the north west corner of the fifty-fifth floor of building 2 to cause that information or that new status to be transmitted via lines 21, 22, 23, and 24 to the four nodes adjacent node 100.

Figure 3:
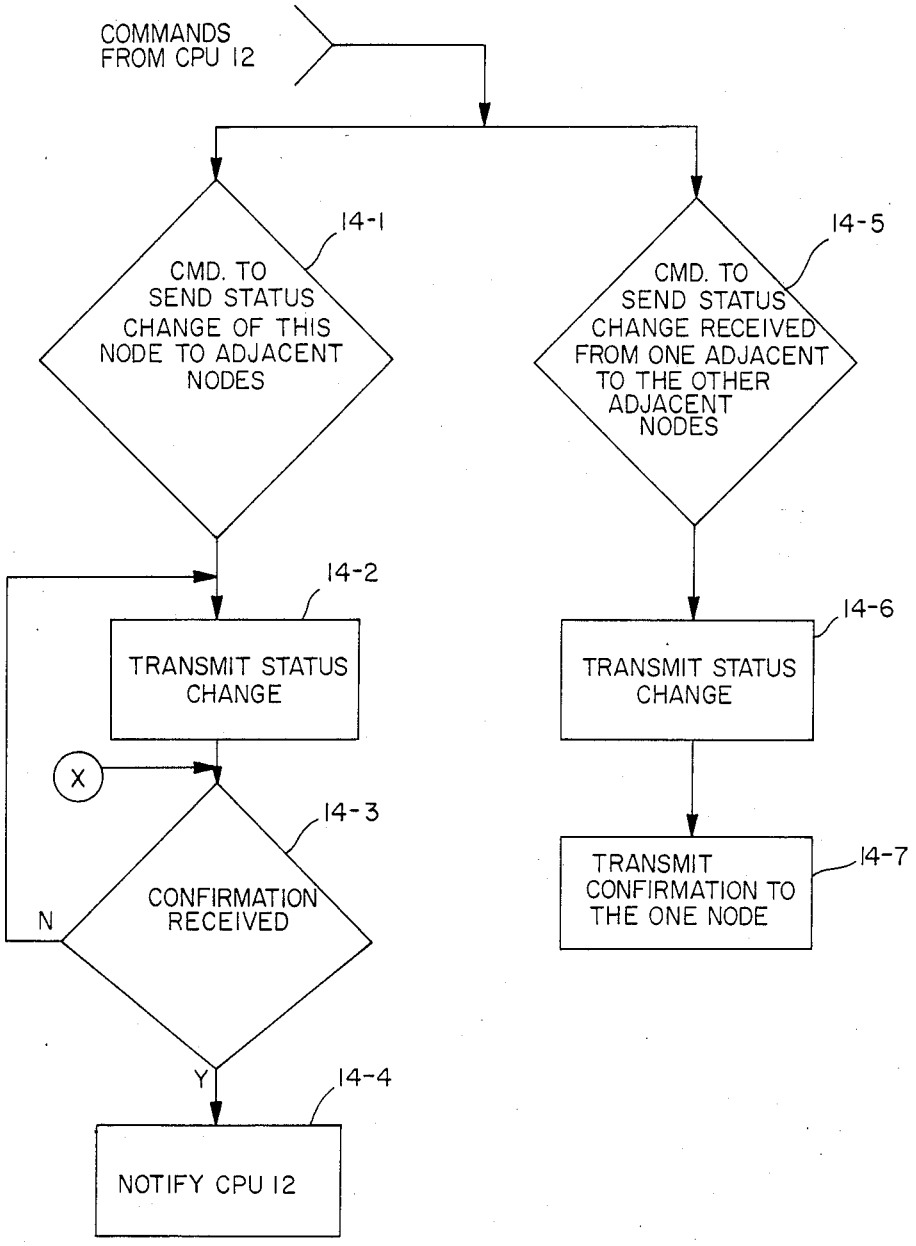
FIG. 3 is a flow chart of a portion of the programming of controller 14 for CPU commands to transmit status changes.

As illustrated in the flow chart of FIG. 3, a CPU command indicative of the alarm condition at node 100 is recognized at block 14-1. The transmission of the status change is then accomplished at block 14-2. One, two, three, or four of the adjacent four nodes may be nodes like node 100 or a microprocessor based fire alarm and emergency communication system similar to the Edwards 6500 manufactured by the Edwards Company, Inc., a unit of General Signal Corporation, 625 Sixth Street East, Owen Sound, Ontario, Canada. One, two or three of the adjacent four nodes may be an intelligent terminal that is a self-contained microcomputer and CRT with a disc drive that provides an auxiliary display and control capability for node 100. The aforementioned intelligent terminal with its own data storage provides the owner of the apparatus of this invention with his own defined system responses, customized messages and operator initiated controls. The above intelligent terminal may be a Zenith Z100 or other self-contained microcomputer.

Serial link controller 13 is coupled to printer 26, remote data gathering panel 27, control panels 28, and CRT 29 or stand alone microcomputer 29. Computer 14 is programmed so that when CPU 12 receives a new status, information may be transmitted from CPU 12 to serial link controller 13 and indicated on: printer 26; panel 27; control panels 28; and CRT 29. Serial link controller 13 and CPU 12 may be programmed so that when certain events (alarm conditions) occur, i.e., the smoke detectors 15 located in building 2 at the south east corner of floor thirty-two detects smoke certain predetermined information will be displayed on: printer 26; panel 27; control panels 28; and CRT 29. This information may be that the smoke detector located at building 2 on the south east corner of floor thirty-two detected smoke and that the occupants of floor thirty-two are requested to immediately leave the building. Also, the system may want to inform the occupants of floors thirty-three and thirty-four of an impending disaster. Any other desired information may be outputted to the aformentioned devices. The output of serial link controller 13 may be coupled to the buildings air handling system so that the above event may direct the air handling system to activate a damper located on the thirty-second floor. In the event one wanted to use the aforementioned system as a security system as well as or in place of a fire alarm and life safety system, infrared detectors and television cameras would be coupled to device 25.

Figure 2:
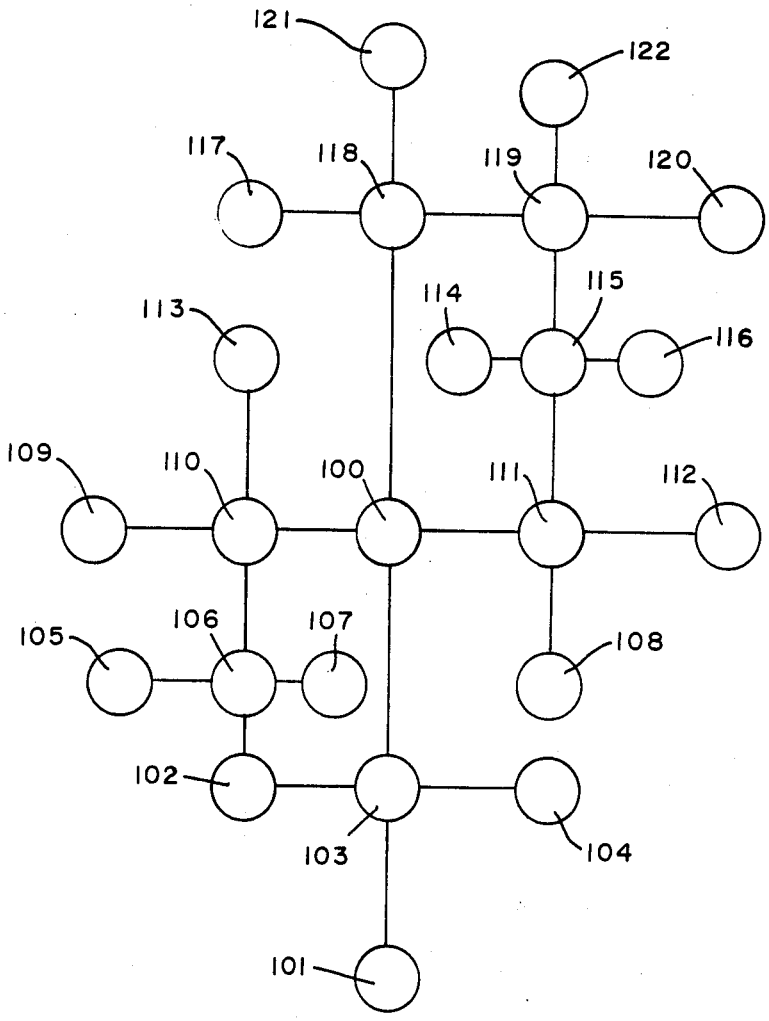
FIG. 2 is a block diagram showing the interconnection of a multiplicity of nodes.

FIG. 2 is a block diagram showing the interconnection of a multiplicity of nodes which are located in different areas of buildings and in different buildings. Node 103 is coupled to node 101, node 104 and node 100, and node 106 is coupled to node 102, node 105, node 107, and node 110. Node 110 is coupled to node 109, node 100 and node 113 and node 111 is coupled to node 100, node 108, node 112, and node 115. Node 115 is coupled to node 114, node 116 and node 119. Node 118 is coupled to node 117, node 100, node 119, and node 121 and node 119 is coupled to node 122, node 120 and node 115. There is no theoretical limit to the number of nodes that may be connected to this invention. However, up to four nodes may be connected to a node that is not currently connected to another node. Communication links between any two adjacent nodes is typically two communication circuits so that if any one communication circuit failed, there would still be a communication link between the two nodes. The two communication circuits are typically installed so that one circuit will be routed differently than the other circuit so that a local fire will be less likely to destroy both communication circuits.

Figure 4:
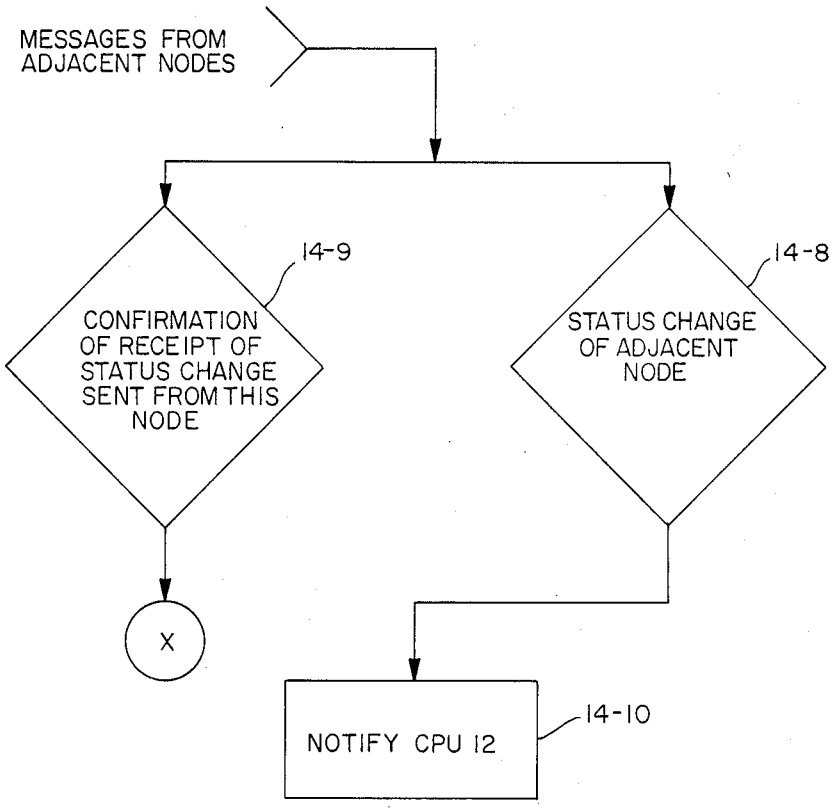
FIG. 4 is a flow chart of another portion of the programming of controller 14 for messages received from adjacent nodes.

For purposes of this discussion we will assume that one of detectors 15 of FIG. 1 detected smoke. Node 100 will then transmit the above status change to node 110, node 103, node 111, and node 118 as illustrated by the FIG. 3 flow chart at blocks 14-2 and 14-3. Thereupon, node 110, node 103, node 111, and node 118 will respond to this new status input in the same manner as node 100. In other words, they will transmit the new information they received over their communications network. Receipt of this information or status change message is illustrated by block 14-8 in the FIG. 4 flow chart. Controller 14 notifies its corresponding CPU of such status change at block 14-10. As illustrated in FIG. 3, the controller 14 of node 110 will recognize at block 14-5 a command from its CPU 12 to transmit this status change to node 113, node 109, node 106, and node 110 will transmit confirmation of this status change to node 100 as illustrated at block 14-7 of FIG. 3. Similarly, node 111 will transmit this status change to node 108, node 112, node 115, and confirmation of this status change to node 100. Node 103 will transmit the above mentioned status change to node 102, node 104, node 101, and confirmation of this status change to node 100. Node 118 will transmit the above status change to node 121, node 117, node 119, and confirmation of this status change to node 100. In the event node 100 did not receive a confirmation that its transmitted signal was received by an adjacent node it would continue sending that signal until it obtained a confirmation of the transfer of the signal. This is illustrated in FIG. 4 by block 14-9 and in FIG. 3 by block 14-3 which tests for the confirmation. If the confirmation is not received, the N connection from block 14-3 returns to the transmit status change block 14-2. If the confirmation has been received, controller 14 notifies CPU 12 of such receipt as at block 14-10.

Each of the aforementioned nodes have their own computer, and they are monitoring local conditions so that if a node receives a new status from another node, the receiving node may be programmed so that the node response will be based upon the status received from the other node as well as its own status. Thus, node 103 may be programmed so that it it receives a particular input from node 100 and its internal inputs are of a certain specified character, node 103 will take a certain predetermined cause of action, i.e., close a specific damper in the air handling system. Thus, it is possible to automatically build into the control program at each of the nodes the logic for controlling that nodes output which may depend upon two or more different inputs from one or more nodes to be satisfied before a particular node takes a specified course of action. One of the advantages of the above is the systems speed of response is increased since every local data collection device in this system does not have to be interrogated before this system can act and enough system inputs are received so that this system does not prematurely respond. Furthermore, each node is a flexible self-contained, self-healing integrated life safety system in which the loss of a communications link between two nodes only destroys the direct communication between those two nodes.

The above specification describes a new and improved integrated life safety system that permits two or more nodes to be interconnected or networked via a minimum wire link, thus providing multiple location control and annunciation. It is realized that the above description may indicate to those skilled in the art additional ways in which the principles of this invention may be used without departing from its spirit. It is, therefore, intended that this invention be limited only by the scope of the appended claims.

What is claimed:

1. In an emergency protection system having a node which is characterized by one or more detectors for sensing alarm conditions, and a computer means for processing such conditions and generating responses for signalling the occurrence of such conditions to other nodes in the system, the improvement which comprises:

(1) A plurality of said nodes, each node being capable of operation independently of the other nodes and each further including:

(a) a communication controller having plural data communication lines;

(b) means responsive to an alarm condition arising at a given node to instruct the communication controller thereat to send changes in alarm condition status to adjacent nodes;

(c) means including said lines for receiving, and replying to, changes in the alarm condition status at adjacent nodes;

(d) means for retransmitting from a given node to a first adjacent node a change in the alarm condition status of another adjacent node received at said given node from said another adjacent node;

(2) means for separately interconnecting said plural data communication lines of the communication controller of each of said nodes to respective adjacent nodes, whereby changes in the alarm condition status of any one node is communicated to all the other nodes in the system.

2. A system as defined in claim 1, in which each communication controller replies to changes in alarm condition status received from an adjacent node to which it is interconnected by transmitting to said adjacent node a confirmation of receipt of such status changes.

3. A system as defined in claim 1, in which each communication controller repetitively transmits changes in alarm condition status to said adjacent nodes to which it is interconnected until a confirmation of receipt of such status change is received.

* * * * *